US009618866B2

(12) United States Patent
Kuwabara

(10) Patent No.: US 9,618,866 B2
(45) Date of Patent: Apr. 11, 2017

(54) DEVELOPER, DEVELOPER STORAGE BODY, DEVELOPING DEVICE AND IMAGE FORMING APPARATUS

(71) Applicant: Oki Data Corporation, Tokyo (JP)

(72) Inventor: Hideharu Kuwabara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/047,679

(22) Filed: Feb. 19, 2016

(65) Prior Publication Data

US 2016/0282738 A1 Sep. 29, 2016

(30) Foreign Application Priority Data

Mar. 27, 2015 (JP) ..... 2015-065844

(51) Int. Cl.

| | |
|---|---|
| ***G03G 9/08*** | (2006.01) |
| ***G03G 9/09*** | (2006.01) |
| ***G03G 9/087*** | (2006.01) |

(52) U.S. Cl.

CPC ..... *G03G 9/0902* (2013.01); *G03G 9/0821* (2013.01); *G03G 9/08755* (2013.01); *G03G 9/0926* (2013.01)

(58) Field of Classification Search

CPC .. G03G 9/0902; G03G 9/0926; G03G 9/0821; G03G 9/08755

USPC ..... 430/107.1, 111.4, 109.4

See application file for complete search history.

(56) References Cited

FOREIGN PATENT DOCUMENTS

JP 2014038131 A 2/2014

*Primary Examiner* — Mark A Chapman

(74) *Attorney, Agent, or Firm* — Panitch Schwarze Belisario & Nadel LLP

(57) ABSTRACT

A developer includes a binder resin, a releasing agent; and a brilliant pigment. A peak endothermic amount of the developer measured using a differential scanning calorimetry (DSC) in a second temperature rising process is in a range from 6.20 to 14.40 J/g.

9 Claims, 9 Drawing Sheets

FIG. 7

| EXAMPLE | TONER | PEAK ENDOTMERMIC AMOUNT (J/g) | MEAN PARTICLE SIZE OF PIGMENT (μm) | EVALUATION RESULT | | |
|---|---|---|---|---|---|---|
| | | | | BRILLIANCE | PRESEVABILITY | TOTAL EVALUATION |
| EXAMPLE 1 | TONER A | 9.29 | 7.67 | EXCELLENT | EXCELLENT | EXCELLENT |
| EXAMPLE 2 | TONER B | 6.20 | 6.82 | GOOD | EXCELLENT | GOOD |
| EXAMPLE 3 | TONER C | 14.40 | 7.24 | EXCELLENT | GOOD | GOOD |
| EXAMPLE 4 | TONER D | 7.95 | 7.65 | EXCELLENT | EXCELLENT | EXCELLENT |
| EXAMPLE 5 | TONER E | 8.23 | 5.37 | EXCELLENT | EXCELLENT | EXCELLENT |
| EXAMPLE 6 | TONER F | 7.65 | 10.04 | EXCELLENT | EXCELLENT | EXCELLENT |
| COMPARISON EXAMPLE 1 | TONER G | 1.94 | 6.95 | POOR | GOOD | POOR |
| COMPARISON EXAMPLE 2 | TONER H | 18.70 | 7.80 | GOOD | POOR | POOR |

DEVELOPER, DEVELOPER STORAGE BODY, DEVELOPING DEVICE AND IMAGE FORMING APPARATUS

BACKGROUND OF THE INVENTION

The present invention relates to a developer used to develop an electrostatic latent image in an electrophotographic image forming apparatus (for example, a printer), and also relates to a developer storage body, a developing device and an image forming apparatus using the developer.

Image forming apparatuses such as a color printer forming color images using electrophotography are in widespread use. In order to form a brilliant image of gold, silver or the like, a brilliant toner (i.e., a brilliant developer) has been developed.

The brilliant toner includes a brilliant pigment. When the brilliant toner is fixed to a recording medium at a high temperature, brilliant pigment particles constituting the brilliant pigment are oriented in a uniform direction, and show high brilliance (See, for example, Japanese Laid-open Patent Publication No. 2014-38131).

However, when the brilliant toner is fixed to the recording medium at a low temperature, so-called hot offset may occur. The hot offset is a phenomenon that a resin or pigment included in the brilliant toner adheres to a fixing member (for example, a fixing roller). In such a case, a quality of an image may be deteriorated.

SUMMARY OF THE INVENTION

An aspect of the present invention is intended to suppress hot offset in high temperature fixing, and to enabling forming a high quality image with high brilliance.

According to an aspect of the present invention, there is provided a developer including a binder resin, a releasing agent and a brilliant pigment. A peak endothermic amount of the developer measured using a differential scanning calorimetry (DSC) in a second temperature rising process is in a range from 6.20 to 14.40 J/g.

According to another aspect of the present invention, there is provided a developer storage body storing the above described developer.

According to still another aspect of the present invention, there is provided a developing device using the above described developer.

According to yet another aspect of the present invention, there is provided an image forming apparatus including the developing device.

With such a configuration, the developer includes an appropriate amount of part having releasability, and therefore it becomes possible to suppress hot offset in high temperature fixing. As a result, it becomes possible to form a high quality image with high brilliance.

BRIEF DESCRIPTION OF THE DRAWINGS

In the attached drawings:

FIG. 7 is a schematic view showing experimental results using toners of Examples 1-6 and Comparison Examples 1 and 2;

DETAILED DESCRIPTION OF THE PREFERRED EMBODIMENT

Figure 1A:
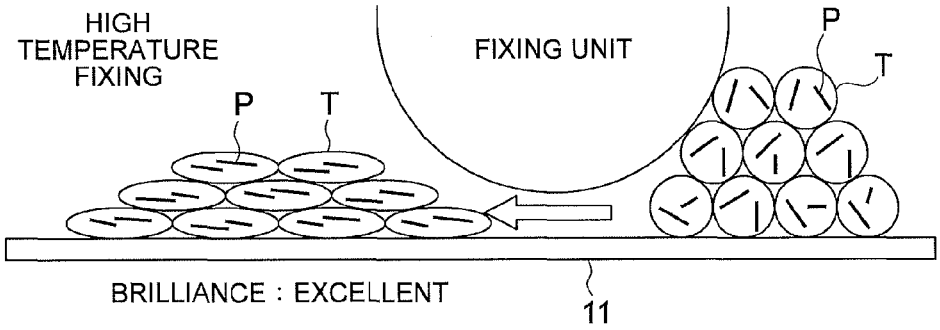
FIGS. 1A and 1B are schematic views showing a process in which a brilliant toner (developer) of the embodiment is fixed to a recording medium.
Figure 1B:
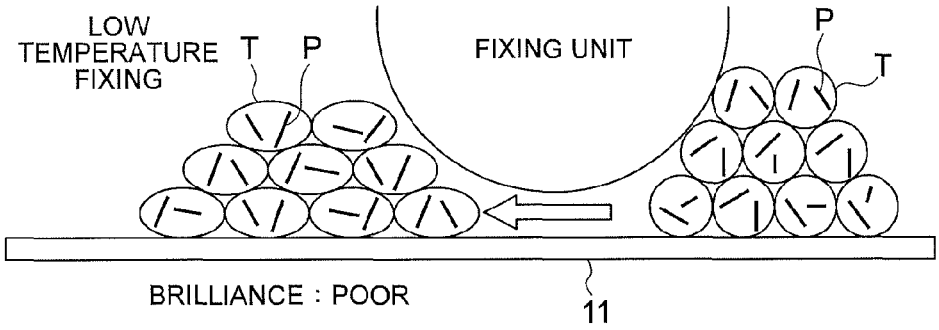

Hereinafter, the embodiment of the present invention will be described with reference to the drawings. FIGS. 1A and 1B are schematic views for illustrating a process in which a brilliant toner (developer) is fixed to the recording medium 11. FIG. 1A shows a case where a fixing temperature is high, and FIG. 1B shows a case where the fixing temperatures is low.

A brilliant toner (indicated by mark "T" in FIG. 1) includes a binder resin, a releasing agent and a brilliant pigment. The brilliant pigment includes brilliant pigment particles P such as aluminum (Al) flakes. Before fixing, the brilliant pigment particles P are oriented in random directions in the brilliant toner T.

When the brilliant toner T is fixed to a recording medium 11 such as a printing paper at a high fixing temperature, a resin viscosity decreases due to the high fixing temperature, and therefore the brilliant toner T is sufficiently pressed flat as shown in FIG. 1A. Therefore, the brilliant pigment particles P are oriented in a substantially uniform direction, and exhibit an action to reflect light on the recording medium 11. In other words, the brilliant toner T shows high brilliance.

In contrast, when the brilliant toner T is fixed to the recording medium 11 at a low fixing temperature, the resin. viscosity does not decrease, and therefore the brilliant toner T is not sufficiently pressed flat as shown in FIG. 1B. Therefore, the brilliant pigment particles P are not uniformly oriented. In this case, the brilliant toner T does not show high brilliance. Therefore, in order to cause the brilliant toner T to show high brilliance, it is necessary that the fixing temperature is high.

In this regard, when the fixing temperature is high, a so-called hot offset may occur. The hot offset is a phenomenon that a resin or pigment included in the brilliant toner T adheres to a fixing roller or the like. Therefore, this embodiment is intended to provide a brilliant toner capable of suppressing hot offset in high temperature fixing.

The brilliant toner (developer) of this embodiment includes a brilliant pigment (for example, aluminum flakes), a releasing agent (for example, paraffin wax), and a binder resin (for example, polyester). To be more specific, the brilliant toner includes an appropriate amount of part having releasability, in order to suppress hot offset in high temperature fixing.

A manufacturing method of brilliant toners of Examples 1 through 6 of this embodiment and Comparison Examples 1 and 2 (for comparison with Examples 1 through 6) will be described.

EXAMPLE 1

First, an aqueous medium (i.e., a aqueous phase) in which an inorganic dispersion agent is dispersed is prepared. To be more specific, 745 weight parts of an industrial trisodium phosphate dodecahydrate is added to 21423 weight parts of pure water, and is dissolved at a liquid temperature of 60° C. Then, the resulting liquid mixture is added with a dilute nitric acid for PH adjustment. Then, the resulting liquid mixture is added with an aqueous solution of calcium chloride in which 360 weight parts of industrial calcium chloride (anhydrous) is dissolved in 3654 weight parts of pure water. Then, the resulting liquid mixture is stirred in a "Line Mill" (manufactured by Primix Corporation) at a rotation speed of 3566 rpm for 34 minutes at a liquid temperature of 60° C. As a result, the aqueous phase including a suspension stabilizer (trisodium phosphate dodecahydrate) as an inorganic dispersion agent is obtained.

Further, an oil medium (i.e., an oil phase) in which a pigment is dispersed is prepared. To be more specific, 83 weight parts of "SOLSPERSE 39000" (manufactured by Lubrizol Corporation) as a polymer dispersion agent and 358 weight parts of "PCS900" (manufactured by Eckart GmbH) as a brilliant pigment are added to and mixed with 7088 weight parts of ethyl acetate as an organic solvent. The resulting liquid mixture is heated to a liquid temperature of 50° C., and is stirred. Then, the resulting liquid mixture is added with 139 weight parts of paraffin wax "SP-0145" (manufactured by Nippon Seiro Co. Ltd) as a releasing agent, 18 weight parts of "FCA-726N" (manufactured by Fujikura Kasei Co. Ltd) as a charge-controlling resin, and 1264 weight parts of polyester (having a number average molecular weight Mn of 11000-14000, a softening temperature Tm of 116.7-119.3° C., and a glass transition temperature Tg of 59.3-68.5° C.) as a binder resin. The resulting liquid mixture is stirred until solid content disappears. As a result, the oil phase is obtained.

Then, the oil phase is added to the aqueous phase whose temperature is kept at 60° C., and is suspended by agitation at a rotation speed of 1650 rpm for 5 minutes, so that particles are formed. After the particles are formed, ethyl acetate is removed by vacuum distillation. As a result, a slurry including a toner (i.e., toner mother particles) is obtained.

Then, the slurry (including the toner) is added with nitric acid to reduce PH to less than or equal to 1.6, and is stirred. Trisodium phosphate (i.e., the suspension stabilizer) is dissolved, and dehydration is performed. Then, the resulting material is dispersed in pure water, and is stirred for washing. Then, dehydration, drying and classification are performed, and toner mother particles are obtained.

Next, an external addition process is performed. To be more specific, 2.0 weight percent (wt %) of a charge controlling agent "X-24-9526N" (manufactured by Shin-Etsu Chemical Co. Ltd) is added to and mixed with 100 weight percent of the toner mother particles. As a result, a toner A is obtained.

In this regard, the brilliant pigment "PCS900" (manufactured by Eckart GmbH) of silver used herein includes aluminum flakes. A mean particle size of the flakes of the brilliant pigment is measured alone using "Coulter Counter" (manufactured by Beckman Coulter Incorporated). As a result of measurement, the mean particle size of the flakes of the brilliant pigment is 8 μm.

EXAMPLE 2

A toner B is manufactured in the same manner as the toner A of Example 1 except that the content of paraffin wax (i.e., the releasing agent) is changed from 139 weight parts to 93 weight parts. Other conditions are the same as those the manufacturing process of the toner A of Example 1.

EXAMPLE 3

A toner C is manufactured in the same manner as the toner A of Example 1 except that the content of paraffin wax (i.e., the releasing agent) is changed from 139 weight parts to 185 weight parts. Other conditions are the same as those the manufacturing process of the toner A of Example 1.

EXAMPLE 4

A toner D is manufactured in the same manner as the toner A of Example 1 except that the releasing agent is changed from paraffin wax to ester wax "WEP-4" (manufactured by NOF Corporation). Other conditions are the same as those the manufacturing process of the toner A of Example 1.

EXAMPLE 5

A toner E is manufactured in the same manner as the toner A of Example 1 except that the brilliant pigment is changed from "PCS900" (manufactured by Eckart GmbH) to "6390NS" (manufactured by Toyo aluminum Kabushiki Kaisha). Other conditions are the same as those the manufacturing process of the toner A of Example 1. The brilliant pigment "6390NS" (manufactured by Toyo aluminum Kabushiki Kaisha) includes aluminum flakes, and a mean particle size thereof measured using "Coulter Counter" is 5 μm.

EXAMPLE 6

A toner F is manufactured in the same manner as the toner A of Example 1 except that the brilliant pigment is changed from "PCS900" (manufactured by Eckart GmbH) to "PCS1000" (manufactured by Eckart GmbH). Other conditions are the same as those the manufacturing process of the toner A of Example 1. The brilliant pigment "PCS1000" (manufactured by Eckart GmbH) includes aluminum flakes, and a mean particle size thereof measured using "Coulter Counter" is 10 μm.

COMPARISON EXAMPLE 1

A toner G is manufactured in the same manner as the toner A of Example 1 except that the content of paraffin wax (i.e., the releasing agent) is changed from 139 weight parts to 42 weight parts. Other conditions are the same as those the manufacturing process of the toner A of Example 1.

COMPARISON EXAMPLE 2

A toner H is manufactured in the same manner as the toner A of Example 1 except that the content of paraffin wax (i.e., the releasing agent) is changed from 139 weight parts to 225 weight parts. Other conditions are the same as those the manufacturing process of the toner A of Example 1.

Measurement of Endothermic Amount of Toner

A peak endothermic amount of each of the toners A through H is measured using a method described below. A differential scanning calorimetry (DSC) is used to measure the peak endothermic amount of the toner. Here, "DSC6220" manufactured by Hitachi High-Tech Science Corporation is used.

Figure 2:
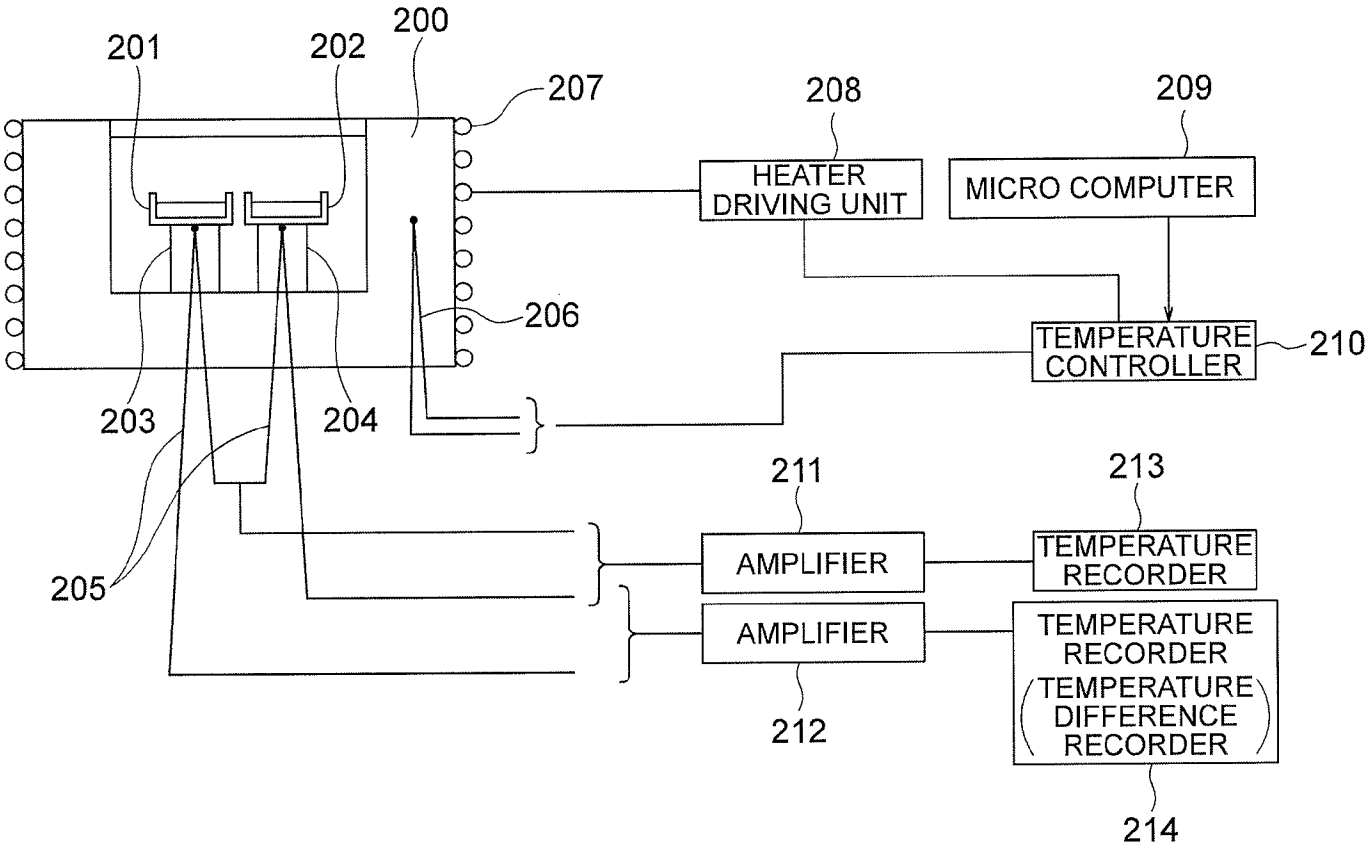
FIG. 2 is a schematic view showing a principle of measurement using a differential scanning calorimetry (DSC)

FIG. 2 is a schematic view for illustrating a principle of measurement using the differential scanning calorimetry (DSC). The differential scanning calorimetry includes a heat sink 200 in which two pans (i.e., holders) 201 and 202 are provided. The pan 201 is provided for holding a reference substance, and the pan 202 is provided for holding a test piece (i.e., sample). A heat resistor 203 is provided between the pan 201 and the heat sink 200. Another heat resistor 204 is provided between the pan 202 and the heat sink 200.

A heater 207 is provided around the heat sink 200, and is controlled by a heater driving unit 208. A temperature of the heat sink 200 is detected by a control temperature sensor 206. The temperature controller 210 controls the temperature of the heat sink 200 by controlling the heater driving unit 208 based on the temperature detected by the control temperature sensor 206. The temperature controller 210 is controlled by a microcomputer 209.

A temperature sensor 205 is, for example, a differential thermocouple, and is attached to predetermined positions of the heat resistors 203 and 204. The temperature sensor 205 is connected to an amplifier 212 and a temperature difference recorder 214 for outputting and recording a temperature difference (DSC signal) between the reference substance and the test piece. The temperature sensor 205 is also connected to an amplifier 211 and a temperature recorder 213 for outputting and recording a temperature of the test piece.

The temperature difference detected by the temperature sensor 205 is based on a difference (i.e., a heat aberration) between a heat flux flowing between the heat sink 200 and the test piece, and a heat flux flowing between the heat sink 200 and the reference substance. Here, measurement is performed by placing the toner (i.e., a target of measurement) on the pan 202, while the pan 201 is kept vacant (i.e., nothing is placed on the pan 201).

Figure 3:
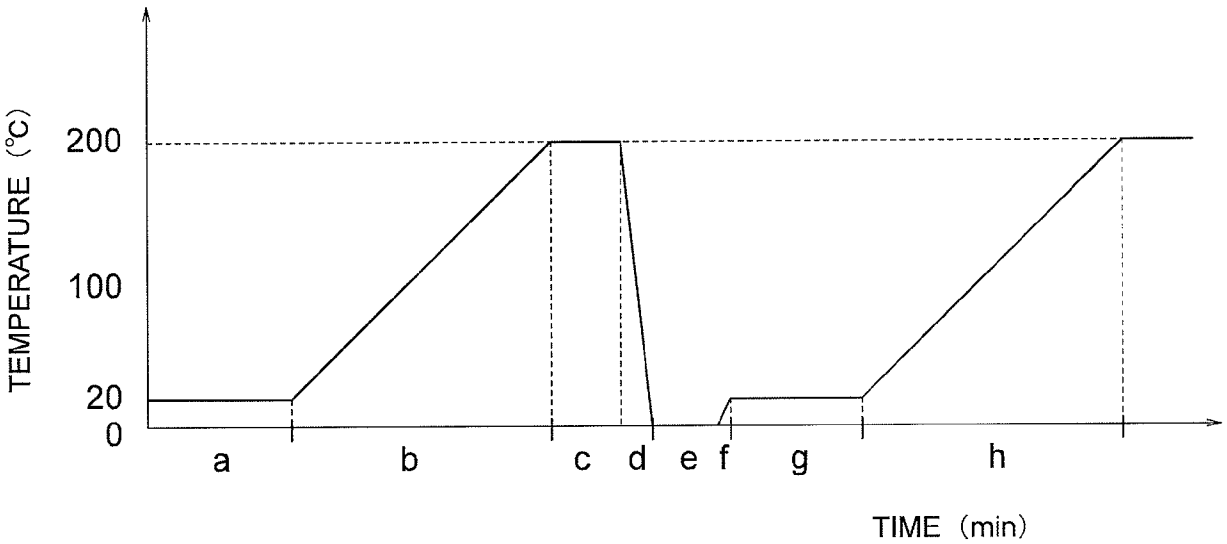
FIG. 3 is a schematic view showing a temperature rising program of the differential scanning calorimetry.

FIG. 3 is a schematic view showing an outline of a temperature rising program of the differential scanning calorimetry. A vertical axis indicates a control temperature (° C.), and a horizontal axis indicates a time (min). In this regard, FIG. 3 shows the control temperature of the differential scanning calorimetry shown in FIG. 2, and does not show an actual temperature of the test piece (toner).

As shown in FIG. 3, the temperature is kept at 20° C. for 10 minutes (i.e., an interval "a" shown FIG. 3), and is increased to 200° C. at a temperature rising rate of 10° C./min (i.e., an interval "b"). Then, the temperature is kept at 200° C. for 5 minutes (i.e., an interval "c"). Then, the temperature is decreased to 0° C. at a temperature drop rate of 90° C./min (i.e., an interval "d"), and is kept at 0° C. for 5 minutes (i.e., an interval "e"). Then, the temperature is increased to 20° C. at a temperature rising rate of 60° C./min (i.e., an interval "f"), and is kept at 20° C. for 10 minutes (i.e., an interval "g"). Then, the temperature is increased to 200° C. at a temperature rising rate of 10° C./min (i.e., an interval "h").

Figure 4:
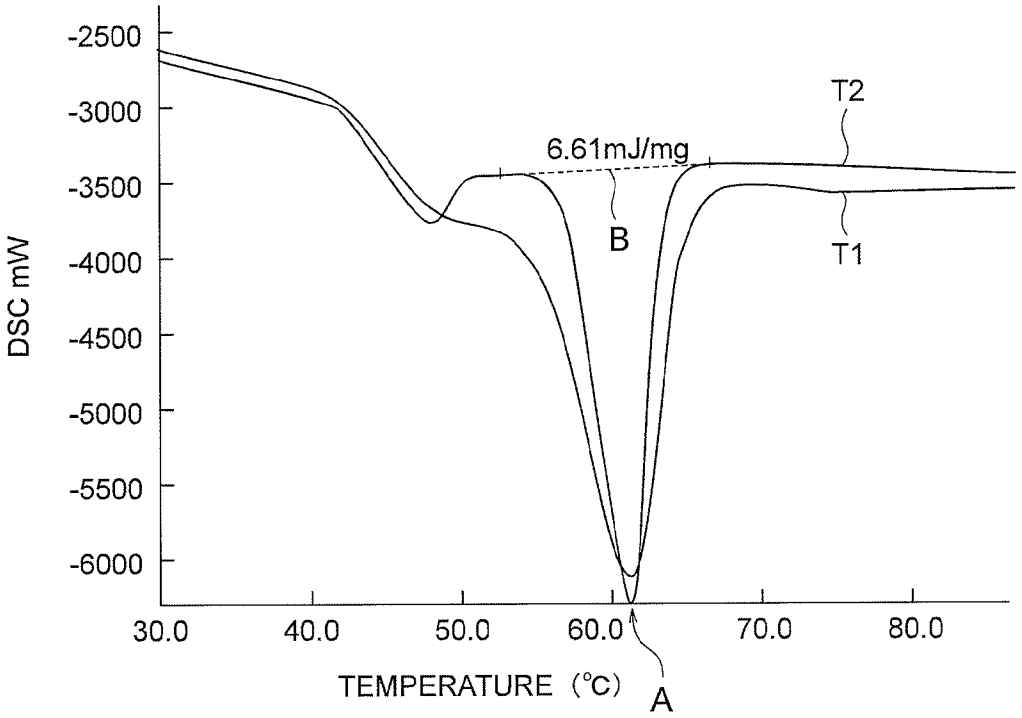
FIG. 4 is a schematic view showing examples of endothermic curves obtained by the differential scanning calorimetry.

FIG. 4 shows examples of endothermic curves in a first temperature rising process (i.e., the interval "b" in FIG. 3) and a second temperature rising process (i.e., the interval "h" in FIG. 3). A endothermic curve represents a relationship between an endothermic amount (mW) and a temperature. In this embodiment, attention is focused on the endothermic curve in the second temperature rising process. The endothermic curve (T2) in the second temperature rising process shown in FIG. 4 has a peak (referred to as an endothermic peak A) at a temperature slightly higher than 60° C. A base line B is drawn to connect a rising edge and a falling edge on both sides of the endothermic peak A. The peak endothermic amount is calculated based on an area of a substantially triangular region from the base line B to the peak A.

In the toner, part (substance) of the toner having releasability is a wax (here, paraffin wax or ester wax), crystalline resin, or the like. These substances have crystallinity, and therefore an endothermic amount that can be measured using the differential scanning calorimeter is large. However, in the endothermic curve in the first temperature rising process, an endothermic peak of the releasing agent and an endothermic peak of other resin overlap each other, and it is difficult to specify the base line. Therefore, in this embodiment, an amount of part of the toner having releasability is determined based on the endothermic curve in the second temperature rising process.

<Measurement of Mean Particle Size of Brilliant Pigment)

Figure 5:
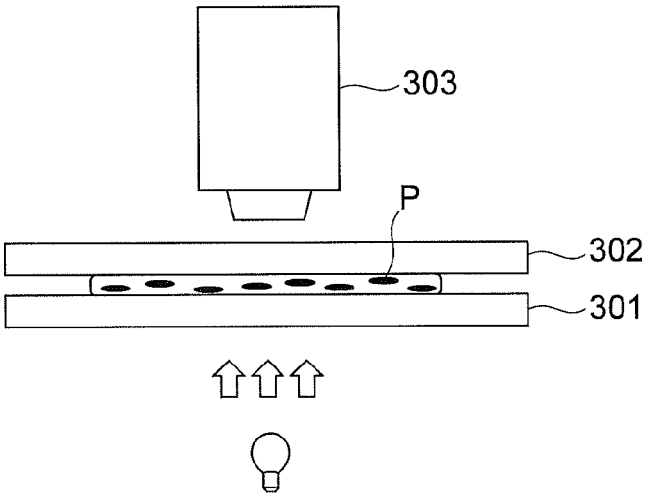
FIG. 5 is a schematic view showing a principle of measurement of, a mean particle size of a brilliant pigment included in the brilliant toner.

FIG. 5 is a schematic view showing a principle of measurement of a mean particle size of the brilliant pigment included in the toner. Here, the toner is dispersed in a surface activating agent "EMULGEN 109P" (manufactured by Kao Corporation). Then, the resulting liquid is dropped on a slide glass 301, and a cover glass 302 is placed thereon. Then, the liquid is observed with a microscope 303 at a magnification of 1000 times using a transmission illumination.

Here, "Digital Microscope VH-5500" (manufactured by Keyence Corporation) is used as the microscope 303, and "EVH-500" (manufactured by Keyence Corporation) is used as a lens of the microscope 303. The brilliant pigment particles (indicated by mark "P" in FIG. 5) block light, and are seen black. Longitudinal dimensions of 50 brilliant pigment particles P are measured, and an average of the measured dimensions is calculated.

<Measurement of Brilliance>

Further, printing is performed on a recording medium (i.e., a printing paper) using the brilliant toner, and brilliance of a fixed toner (developer) is measured. Here, "MICROLINE 910PS" (manufactured by Oki Data Corporation) is used as a printer, and "Color Laser Paper" (manufactured by Sakae Technical Paper Co. Ltd) of A4 size and having a basis weight of 186 g/m$^2$ is used as the recording medium. A printing pattern is a solid image of 100% duty. An amount of the toner adhering to a surface of the recording medium is in a range from 0.45 to 0.55 mg/cm$^2$. The fixing temperature is set to 200° C. and 210° C. An environmental temperature is 23° C., and a relative humidity is 50%.

The brilliance of the printed solid image is measured using a goniophotometer "GC-5000L" (manufactured by Nippon Denshoku Industries Co. Ltd). The brilliance is determined based on a flop index value (FI value) calculated by the following equation (1):

$$FI=2.69\times(L^*_{30}-L^*_{-65})^{1.11}/(L^*_0)^{0.86} \quad (1)$$

As the FI value is higher, the brilliance is higher. As the FI value is lower, the brilliance is lower. Here, when the FI value is higher than or equal to 20 in the case where the fixing temperature is 210° C., the brilliance is determined to be excellent. Even when the FI value is lower than 20 in the case where the fixing temperature is 210° C., the brilliance is determined to be good (i.e., acceptable) when the FI value is higher than or equal to 20 in the case where the fixing temperature is 200° C. When the FI value is lower than 20 in the case where the fixing temperature is 200° C., the brilliance is determined to be poor.

<Measurement of Preservability of Toner>

Figure 6A:
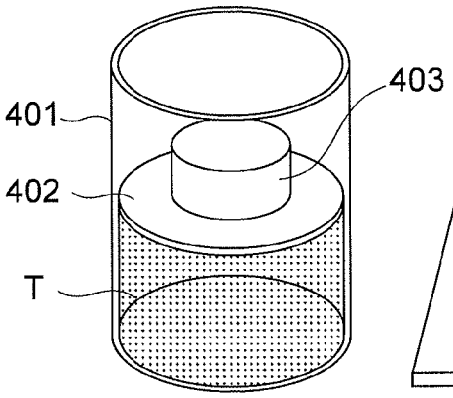
FIGS. 6A and 6B are schematic views showing a principle of measurement of a preservability of the toner.
Figure 6B:
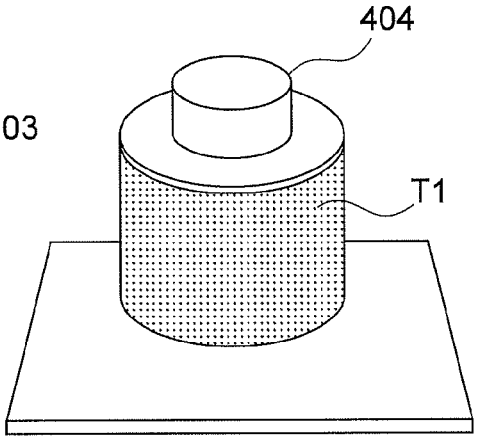

In this embodiment, a preservability of the toner is measured. When the toner includes a large amount of part having releasability, a phenomenon (i.e., toner blocking) that toner particles are agglomerated is likely to occur. FIGS. 6A and 6B are schematic views showing a principle of measurement of the preservability of the toner. First, as shown in FIG. 6A, the toner T of 10 g is put into a cylindrical container 401 (having an inner diameter of 28 mm), and a circular disk 402 is placed on the toner T. The circular disk 402 has a diameter which is substantially the same as the inner diameter of the cylindrical container 401. A weight 403 of 20 g is placed on the circular disk 402. The toner T is kept in this state for 48 hours at a temperature of 50° C. and a relative humidity of 55%. When 48 hours have elapsed, the weight 403, the disk 402 and the cylindrical container 401 are removed, and agglomerate T1 of the toner is obtained. Then, another weight 404 is placed on the agglomerate T1. The weight 404 is gradually increased, and a weight (g) of the weight 404 is checked when the agglomerate T1 of the toner collapses.

As the preservability is better, the agglomerate collapses with a lighter weight. Here, the preservability is determined to be excellent when the agglomerate collapses with the weight lighter than 50 g. The preservability is determined to be good when the agglomerate collapses with the weight heavier than or equal to 50 g and lighter than 110 g. The preservability is determined to be poor when the agglomerate collapses with the weight heavier than 110 g.

<Measurement Results>

FIG. 7 shows measurement results of the toners A through F of Examples 1 through 6 and the toners H and G of Comparison Examples 1 and 2. To be more specific, FIG. 7 shows measurement results on the peak endothermic amounts and the mean particle sizes, evaluation results on the brilliance and preservability, and total evaluation results.

In Example 1, the peak endothermic amount of the toner A is 9.29 J/g, and the mean particle size of the pigment is 7.67 μm. In Example 2, the peak endothermic amount of the toner B is 6.20 J/g, and the mean particle size of the pigment is 6.82 μm. In Example 3, the peak endothermic amount of the toner C is 14.40 J/g, and the mean particle size of the pigment is 7.24 μm. In Example 4, the peak endothermic amount of the toner D is 7.95 J/g, and the mean particle size of the pigment is 7.65 μm. In Example 5, the peak endothermic amount of the toner E is 8.23 J/g, and the mean particle size of the pigment is 5.37 μm. In Example 6, the peak endothermic amount of the toner F is 7.65 J/g, and the mean particle size of the pigment is 10.04 μm.

In Comparison Example 1, the peak endothermic amount of the toner G is 1.94 J/g, and the mean particle size of the pigment is 6.95 μm. In Comparison Example 2, the peak endothermic amount of the toner H is 18.70 J/g, and the mean particle size of the pigment is 7.80 μm.

In the cases of the toners A through F of Embodiments 1 through 6 (i.e., when the peak endothermic amount measured using the differential scanning calorimeter in the second temperature rising process is in a range of 6.20 to 14.40 J/g), the evaluation results of the brilliance and preservability are excellent or good. Therefore, the total evaluation results are excellent or good.

In contrast, in the case of the toner G of Embodiment 5 (i.e., when the peak endothermic amount in the second temperature rising process is less than 6.20 J/g), the brilliance is poor. This is because the amount of the part of the toner having releasability is small, and hot offset where the resin or pigment adheres to a fixing roller is likely to occur in high temperature fixing (200° C.).

Further, in the case of the toner H of Embodiment 6 (i.e., when the peak endothermic amount in the second temperature rising process is greater than 14.40 J/g), the preservability is poor. This is because the amount of the part of the toner having releasability is large, and the blocking of the toner is likely to occur.

From the above described results, it is understood that hot offset in high temperature fixing is prevented and high brilliance and preservability are obtained, when the peak endothermic amount measured using the differential scanning calorimeter in the second temperature rising process is in a range from 6.20 to 14.40 J/g (i.e., Examples 1 through 6).

Further, in the case of the toner A, D, E and F (i.e., Examples 1, 4, 5 and 6) among the toners A through F of the Examples 1 through 6, the evaluation results on the brilliance and preservability are both excellent, and therefore the total evaluation results are excellent.

In contrast, in the case of the toner B (i.e., Example 2), the evaluation result on the preservability is excellent, but the evaluation result on the brilliance is good since hot offset occurs when the fixing temperature is 210° C. In the case of the toner C (i.e., Example 3), the evaluation result on the brilliance is excellent, but the evaluation result on the preservability is good since the agglomerate collapses when the weight is heavier than or equal to 50 g and lighter than 110 g.

In the cases of the toner A, D, E and F, the peak endothermic amount measured using the differential scanning calorimeter in the second temperature rising process is in a range from 7.65 to 9.29 J/g. Therefore, it is most preferable that the peak endothermic amount measured using the differential scanning calorimeter in the second temperature rising process is in a range from 7.65 to 9.29 J/g.

Further, in the case of the brilliant toners (i.e., the toners A through F of Examples 1 through 6) providing the high brilliance and high preservability, the mean particle size of the brilliant pigment is in a range from 5.37 to 10.04 μm. In this regard, the brilliant pigment is not limited to aluminum flakes. The brilliant pigment may be brass, titanium oxide, flaky glass powder deposited with metal, or the like.

In the above described experiments, the fixing temperature is set to 200° C. and 210° C. In this regard, when the experiments are performed by setting the fixing temperature to 140° C., the FI value is less than 20 (i.e., poor) for each of the toners of Examples 1 through 6 and Comparison Example 1 and 2. This is because, when the fixing temperature is low, the resin viscosity does not decrease, and the brilliant toner is not sufficiently pressed flat (and therefore the brilliant pigment particles are not uniformly oriented) as was described with reference to FIG. 1B.

<Advantages of Embodiment>

As described above, the developer of this embodiment includes a binder resin, a releasing agent and a brilliant pigment. Further, the peak endothermic amount measured using the differential scanning calorimeter (DSC) in the second temperature rising process is in a range from 6.20 to 14.40 J/g. With such a configuration, the developer shows high brilliance, and suppresses hot offset in high temperature fixing. Therefore, it becomes possible to form a high quality image with high brilliance.

Further, when the peak endothermic amount in the second temperature rising process is in a range from 7.65 to 9.29 J/g, and when the mean particle size of the brilliant pigment of the brilliant toner is in a range from 5.37 to 10.04 μm, it becomes possible to form a higher quality image with higher brilliance.

<Configuration of Image Forming Apparatus>

Figure 8:
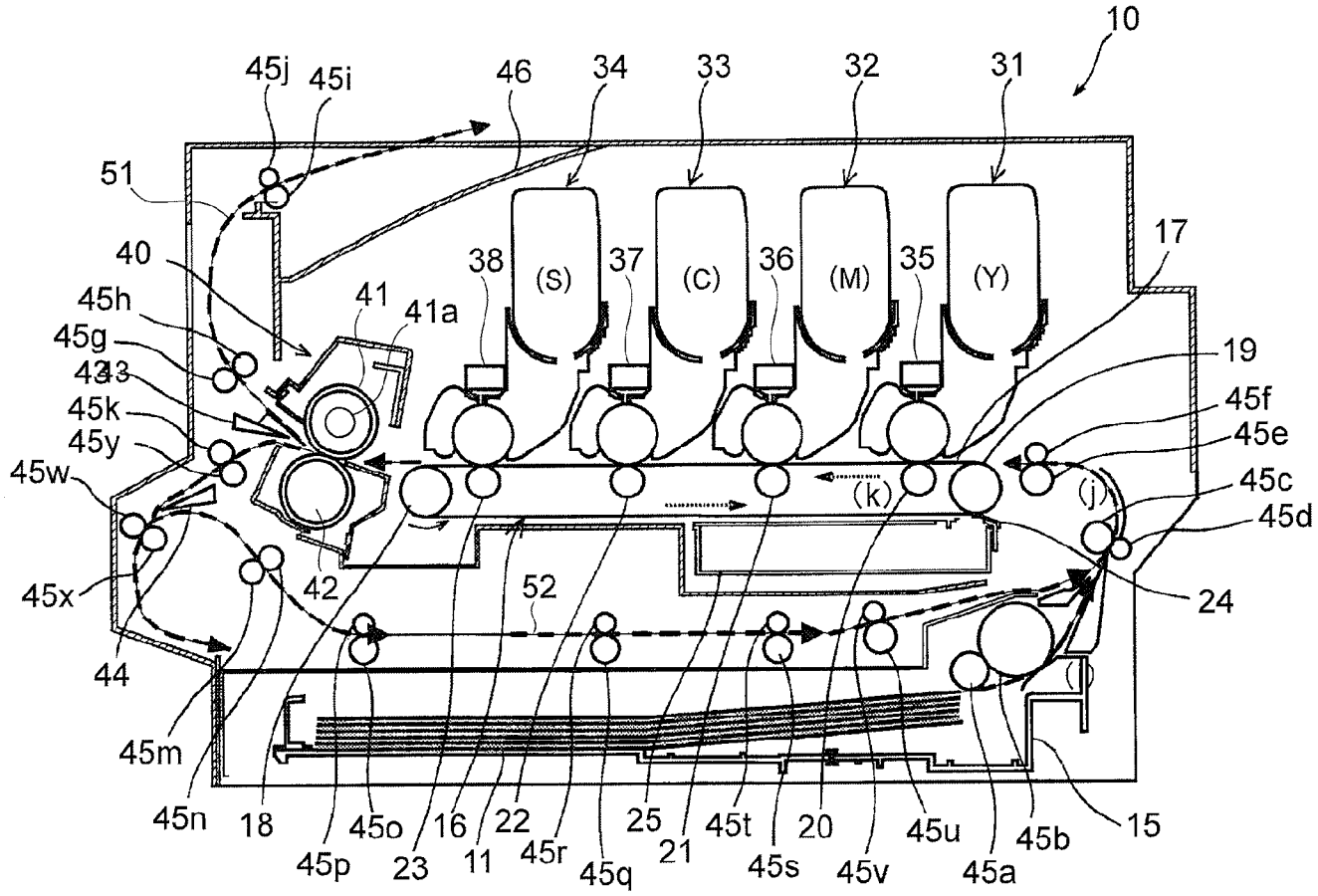
FIG. 8 shows a configuration example of an image forming apparatus using the brilliant toner (developer) of the embodiment.

Next, a configuration of an image forming apparatus 10 of this embodiment will be described. FIG. 8 shows a basic configuration of the image forming apparatus. The image forming apparatus 10 forms an image using electrophotography. The image forming apparatus 10 includes a medium cassette 15, image forming units 31, 32, 33 and 34, LED (Light Emitting Diode) heads 35, 36, 37 and 38, a transfer unit 16, and a fixing unit 40.

The medium cassette 15 is detachably mounted to a lower portion of a main body of the image forming apparatus 10. The medium cassette 15 stores a stack of recording media 11 (for example, printing papers). The pickup roller 45*a* is provided so as to contact a surface of an uppermost recording medium 11 of the stack stored in the medium cassette 15. The pickup roller 45*a* feeds the recording media 11 one by one out of the medium cassette 15. A feed roller 45*b* is provided in adjacent to the pickup roller 45*a*. The feed roller 45*b* feeds the recording medium 11 in a direction shown by an arrow "i".

Transport rollers 45*c* and 45*d* and transport rollers 45*e* and 45*f* are disposed along a transport path of the recording medium 11 fed by the feed roller 45*b*. The transport rollers 45*c* and 45*d* and the transport rollers 45*e* and 45*f* correct a skew of the recording medium 11, and transport the recording medium 11 towards the image forming units 31, 32, 33 and 34.

The image forming units 31, 32, 33 and 34 form images using toners (developers) of yellow (Y), magenta (M), cyan (C) and silver (S). The image forming units 31, 32, 33 and 34 respectively include photosensitive drums 101 as image bearing bodies.

The LED heads 35, 36, 37 and 38 are disposed above the respective photosensitive drums 101 of the image forming units 31, 32, 33 and 34 so as to face the photosensitive drums 101. Each of the LED heads 35, 36, 37 and 38 includes, for example, LED elements and a lens array. Each of the LED heads 35, 36, 37 and 38 is located at a position where light emitted by the LED element is focused on the surface of the photosensitive drum 101.

The image forming units 31, 32, 33 and 34 have the same configuration except for the toners to be used. Here, a configuration of the image forming unit 34 using the silver toner (i.e., brilliant toner) will be described.

Figure 9:
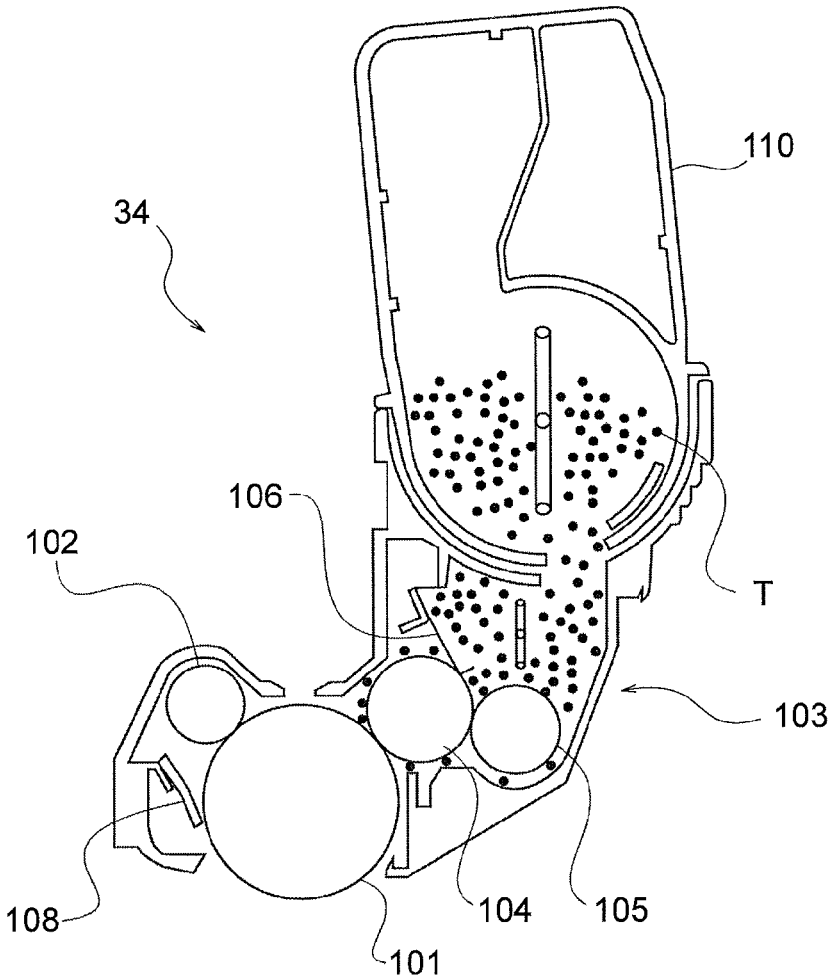
FIG. 9 shows a configuration example of a developing device (i.e., an image foisting unit) using the brilliant toner of the embodiment.

FIG. 9 shows a configuration of the image forming unit 34. The image forming unit 34 includes the photosensitive drum 101 as a latent image bearing body (i.e., an image bearing body), a charging roller 102 as a charging member, a developing roller 104 as a developer bearing body, a supplying roller 105 as a supplying member, a developing blade 106 as a developer layer forming member, a developer storage body 110, and a cleaning blade 108 as a cleaning member.

A unit including the developing roller 104, the supplying roller 105, the developing blade 106 and the developer storage body 110 (i.e., elements contributing to developing of a latent image) constitutes a developing unit 103. In this embodiment, the image forming unit 34 (including the photosensitive drum 101, the charging roller 102 and the developing unit 103) corresponds to a developing device. However, it is also possible that the developing unit 103 (contributing to developing of a latent image) is referred to as a developing device.

The photosensitive drum 101 includes, for example, a conductive support body of aluminum or the like, and a photosensitive layer (including a charge generation layer and a charge transport layer) on the surface of the conductive support body. The photosensitive drum 101 rotates clockwise in FIG. 9. The photosensitive layer of the photosensitive drum 101 is exposed with light emitted by the LED head 38 (FIG. 8), and a latent image (i.e., an electrostatic latent image) is formed thereon.

The charging roller 102 is disposed so as to contact the surface of the photosensitive drum 101. The charging roller 102 includes, for example, a metal shaft and a semiconductive epichlorohydrin rubber layer. The charging roller 102 is applied with a charging voltage, and uniformly charges the surface of the photosensitive drum 101.

The developing roller 104 is disposed so as to contact the surface of the photosensitive drum 101. The developing roller 104 includes, for example, a metal shaft and a semiconductive urethane rubber layer. The developing roller 104 is applied with a developing voltage, and develops the latent image of the surface of the photosensitive drum 101 with the toner.

The supplying roller 105 is disposed so as to contact a surface of the developing roller 104, or so as to face the developing roller 104 with a certain gap formed therebetween. The supplying roller 105 includes, for example, a metal shaft and a semiconductive foam silicone sponge layer. The supplying roller 105 is applied with a supplying voltage, and supplies the toner to the developing roller 104.

The developing blade 106 is disposed so as to contact a surface of the developing roller 104. The developing blade 106 is, for example, a blade made of stainless steel. The developing blade 106 is applied with a blade voltage, and regulates a thickness of a toner layer (i.e., a developer layer) on the surface of the developing roller 104.

The cleaning blade 108 is disposed so as to contact the surface of the photosensitive drum 101. The cleaning blade 108 is, for example, a blade made of urethane rubber. The cleaning blade 108 removes a residual toner remaining on the surface of the photosensitive drum 101.

The developer storage body 110 is a developer cartridge detachably mounted to the developing unit 103. The developer storage body 110 stores the toner (developer), and replenishes the toner to the developing roller 104 and the supplying roller 105. The developer storage body 110 of the image forming unit 34 stores the brilliant toner of silver.

Figure 10:
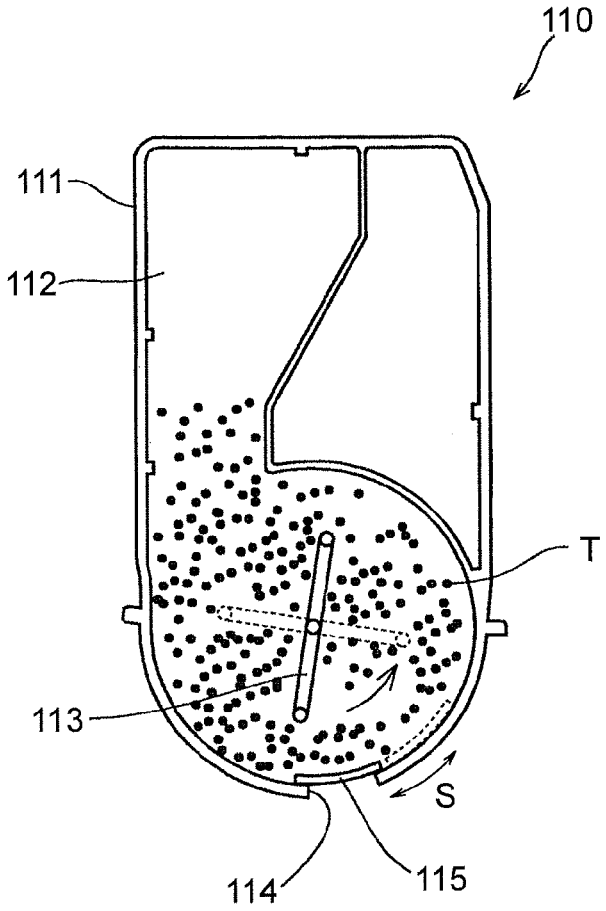
FIG. 10 shows a configuration example of a developer storage body storing the brilliant toner of the embodiment.

FIG. 10 shows an internal configuration of the developer storage body 110. As shown in FIG. 10, the developer storage body 110 has a container 111 including a developer storage portion 112. An agitation bar 113 is rotatably supported in the developer storage portion 112, and extends in a longitudinal direction of the developer storage portion 112. An ejection opening 114 is provided on a lower side of the developer storage body 110. The toner stored in the container 111 is ejected through the ejection opening 114. The ejection opening 114 is opened and closed by a shutter 115 which is slidable in a direction as shown by an arrow S.

Referring back to FIG. 8, the transfer unit 16 is disposed below the image forming units 31, 32, 33 and 34. The transfer unit 16 includes a transfer belt 17, a driving roller 18, a tensioning roller 19, transfer rollers 20, 21, 22 and 23, a transfer belt cleaning blade 24, and a waste developer storage tank 25.

The transfer belt 17 is formed of polyamide imide or polyamide, and is added with carbon or the like to increase a predetermined conductivity and mechanical strength. The transfer belt 17 is stretched around the driving roller 18 and the tensioning roller 19. The transfer belt 17 holds the recording medium 11 on a surface thereof with electrostatic adsorption, and transports the recording medium 11 along the image forming units 31, 32, 33 and 34. The driving roller 18 rotates in counterclockwise in FIG. 8 to move the transfer belt 17. The tensioning roller 19 is paired with the driving roller 18, and applies a certain tension to the transfer belt 17.

The transfer rollers 20, 21, 22 and 23 are disposed so as to face the respective photosensitive drums 101 of the image forming units 31, 32, 33 and 34 via the transfer belt 17. Each of the transfer rollers 20, 21, 22 and 23 is applied with a transfer voltage, and transfers the toner image form the photosensitive drum 101 to the recording medium 11.

The transfer belt cleaning blade 24 is disposed so as to contact the surface of the transfer belt 17. The transfer belt cleaning blade 24 scrapes off the toner (i.e., a waste toner) from the surface of the transfer belt 17. The waste developer storage tank 25 is a container for storing the waste toner scraped off by the transfer belt cleaning blade 24.

The fixing unit 40 is disposed downstream of the image forming units 31, 32, 33 and 34 and the transfer unit 16 in a transport direction of the recording medium 11. The fixing unit 40 includes a heating roller 41 and a pressure roller 42.

The heating roller 41 includes a hollow cylindrical core of aluminum, a heat resistant resilient layer of silicone rubber covering the core, and a PFA (copolymer of tetrafluoroethylene and per-fluoroalkyl vinyl ether) tube covering the resilient layer. A heater 41*a* such as a halogen lamp is provided inside the core of the heating roller 41.

The pressure roller 42 includes a core of aluminum, a heat resistant resilient layer of silicone rubber covering the core, and a PFA tube covering the resilient layer. The pressure roller 42 is provided so as to form a nip portion between the heating roller 41 and the pressure roller 42.

A switching guide 43 is provided downstream (i.e., left in FIG. 8) of the fixing unit 40 in the transport direction of the recording medium 11. The switching guide 43 is provided for switching between transport paths of the recording medium 11. The switching guide 43 selectively guides the recording medium (ejected by the fixing unit 43) to an ejection transport path 51 or a return transport path 52.

Transport rollers 45*g* and 45*h* and ejection rollers 45*i* and 45*j* are disposed along the ejection transport path 51. The transport rollers 45*g* and 45*h* and the ejection rollers 45*i* and 45*j* eject the fixing unit 40 to outside of the image forming apparatus 10. Further, a stacker portion 46 is provided on a top cover of the image forming apparatus 10 for placing the ejected recording medium 11.

Transport rollers 45*k* and 45*y*, a switching guide 44 and transport rollers 45*w* and 45*x* are disposed along the return transport path 52. The transport rollers 45*k* and 45*y*, the switching guide 44 and the transport rollers 45*w* and 45*x* are configured to transport the recording medium 11 (ejected from the fixing unit 40) into a retreat path, and then transport the recording medium 11 in a reverse direction out of the retreat path. Further, transport rollers 45*m* and 45*n*, transport rollers 45*o* and 45*p*, transport rollers 45*q* and 45*r*, transport rollers 45*s* and 45*t*, and transport rollers 45*u* and 45*v* are disposed along the return transport path 52. The transport rollers 45*m* and 45*n*, the transport rollers 45*o* and 45*p*, the transport rollers 45*q* and 45*r*, the transport rollers 45*s* and 45*t*, and the transport rollers 45*u* and 45*v* are configured to transport the recording medium 11 to the above described transport rollers 45*c* and 45*d*.

<Operation of Image Forming Apparatus>

Next, an operation of the image forming apparatus 10 will be described. The pickup roller 45*a* and the feed roller 45*b* feed each recording medium 11 in the direction shown by the arrow "i" out of the medium cassette 15. The transport rollers 45*c* and 45*d* and the transport rollers 45*e* and 45*f* transport the recording medium 11 (fed out of the medium cassette 15) in a direction shown by an arrow "j", while correcting the skew of the recording medium 11.

The transfer belt 17 of the transfer unit 16 moves by a rotation of the driving roller 18, adsorbs the recording medium 11 transported from the transport rollers 45*e* and 45*f*, and transports the recording medium 11 in a direction shown by an arrow "k".

In the image forming unit 31, the photosensitive drum 101 (FIG. 9) rotates clockwise at a constant speed. The charging roller 102 rotates following a rotation of the photosensitive drum 101, and uniformly charges the surface of the photosensitive drum 101. The LED head 35 emits light so as to expose the surface of the photosensitive drum 101 based on image data of yellow, and forms a latent image.

Further, the supplying roller 105 supplies the toner replenished from the developer storage body 110 to the developing roller 104. A toner thin layer is formed on the surface of the developing roller 104, and a thickness of the toner thin layer is regulated by the developing blade 106. The toner thin layer adheres to the latent image on the surface of the photosensitive drum 101. That is, the latent image is developed, and a toner image (i.e., a developer image) is formed.

The toner image (yellow) formed on the surface of the photosensitive drum 101 is transferred to the recording medium. 11 on the transfer belt 17 due to the transfer voltage applied to the transfer roller 20.

Similarly, the transfer belt 17 transports the recording medium 11 along the image forming units 32, 33 and 34, and toner images of magenta, cyan and silver are transferred to the recording medium 11.

The recording medium 11 to which the toner images of the respective colors are transferred is transported by the transfer belt 17 to the fixing unit 40. In the fixing unit 40, the heating roller 41 and the pressure roller 42 apply heat and pressure to the recording medium 11. The toner image is molten, and is fixed to the recording medium 11. The recording medium 11 to which the toner image is fixed is transported along the ejection transport path 51 by the transport rollers 45*g* and 45*h* and the ejection rollers 45*i* and 45*j*, is ejected to outside of the image forming apparatus 10, and is placed on the stacker portion 46.

In the case of the duplex printing, the recording medium 11 ejected from the fixing unit 40 is once transported, into the retreat path, and is transported in a reverse direction out of the retreat path by the switching guide 44, the transport rollers 45*k* and 45*y*, and the transport rollers 45*w* and 45*x*. Then, the recording medium 11 is transported along the return transport path 52 by the switching guide 44, the transport rollers 45*m* and 45*n*, the transport rollers 45*o* and 45*p*, the transport rollers 45*q* and 45*r*, the transport rollers 45*s* and 45*t*, and the transport rollers 45*u* and 45*v*, and reaches the transport rollers 45*c* and 45*d*. Subsequently, image formation on a second surface (i.e., a back surface) is performed.

In the above description, a color image forming apparatus has been described. However, the present invention is also applicable to a monochrome image forming apparatus. Further, the image forming apparatus is not limited to a printer, but may be a copier, a facsimile machine, MFT (Multifunction Peripheral) or the like.

While the preferred embodiments of the present invention have been illustrated in detail, it should be apparent that modifications and improvements may be made to the invention without departing from the spirit and scope of the invention as described in the following claims.

What is claimed is:

1. A developer comprising:

a binder resin;

a releasing agent; and, a brilliant pigment, wherein a peak endothermic amount of the developer measured using a differential scanning calorimetry (DSC) in a second temperature rising process is in a range from 6.20 to 14.40 J/g.

2. The developer according to claim 1, wherein the peak endothermic amount of the developer measured using the differential scanning calorimetry in the second temperature rising process is in a range from 7.65 to 9.29 J/g.

3. The developer according to claim 1, wherein the brilliant pigment has a mean particle size in a range from 5.37 to 10.04 μm.

4. The developer according to claim 1, wherein the brilliant pigment includes aluminum flakes.

5. The developer according to claim 1, wherein the binder resin includes polyester.

6. The developer according to claim 1, wherein the releasing agent includes paraffin wax or ester wax.

7. A developer storage body storing the developer according to claim 1.

8. A developing device using the developer according to claim 1.

9. An image forming apparatus including the developing device according to claim 8.

* * * * *